US009330631B2

(12) United States Patent
Lee et al.

(10) Patent No.: US 9,330,631 B2
(45) Date of Patent: May 3, 2016

(54) DISPLAY APPARATUS

(71) Applicant: Samsung Display Co., Ltd., Gyeonggi-do (KR)

(72) Inventors: Jae-Han Lee, Yongin (KR); Taegon Kim, Yongin (KR); Young-Il Ban, Yongin (KR); Sunkyu Son, Yongin (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 107 days.

(21) Appl. No.: 14/226,092

(22) Filed: Mar. 26, 2014

(65) Prior Publication Data

US 2014/0347404 A1 Nov. 27, 2014

(30) Foreign Application Priority Data

May 27, 2013 (KR) ..... 10-2013-0059807

(51) Int. Cl.
*G09G 5/18* (2006.01)
*G09G 3/20* (2006.01)

(52) U.S. Cl.
CPC .. *G09G 5/18* (2013.01); *G09G 3/20* (2013.01); *G09G 2320/0276* (2013.01); *G09G 2330/028* (2013.01); *G09G 2370/08* (2013.01)

(58) Field of Classification Search
CPC combination set(s) only.
See application file for complete search history.

(56) References Cited

U.S. PATENT DOCUMENTS

2008/0018569 A1 1/2008 Sung et al.
2011/0050676 A1* 3/2011 Lee ..... G09G 3/3233 345/212
2012/0249514 A1 10/2012 Ahn
2013/0021229 A1 1/2013 Ludden
2015/0194107 A1* 7/2015 Bae ..... G09G 3/3607 345/696

FOREIGN PATENT DOCUMENTS

KR 10-2006-0131341 A 12/2006
KR 10-2008-0105642 A 12/2008
KR 10-2009-0058055 A 6/2009
KR 10-2009-0091960 A 8/2009
KR 10-2010-0006790 A 1/2010
KR 10-2011-0006366 A 1/2011
KR 10-2011-0046848 A 5/2011

* cited by examiner

*Primary Examiner* — Van Chow
(74) *Attorney, Agent, or Firm* — Lee & Morse, P.C.

(57) ABSTRACT

A controller for a display panel includes a detector, a timing controller, and a voltage generator. The detector detects a predetermined pattern in an image signal. The timing controller generates a control signal based on detection of the pattern. The voltage generator changes at least one driving voltage for a display panel from a first level to a second level based on the control signal. The predetermined pattern may correspond to at least one region having a predetermined arrangement of at least first and second gray scale values of pixels in an image corresponding to the image signal.

14 Claims, 9 Drawing Sheets

DISPLAY APPARATUS

CROSS-REFERENCE TO RELATED APPLICATION

Korean Patent Application No. 10-2013-0059807, filed on May 27, 2013, and entitled "Display Apparatus," is incorporated by reference herein in its entirety.

BACKGROUND

1. Field

One or more embodiments described herein relate to a display apparatus.

2. Description of the Related Art

A display apparatus may include data and gate drivers for driving a display panel to display images. Each of the pixels in the panel may include a switching transistor, a crystal capacitor, and a storage capacitor. In operation, the data driver outputs data driving signals to data lines and the gate driver outputs gate driving signals for driving gate lines coupled to the pixels.

When an image signal from an external device has a predetermined image pattern, power consumption and temperature of the data driver driving the data lines may increase. This occurs, for example, when the image signal corresponds to a white gray scale and an image signal corresponding to a black gray scale are alternately received in each of a plurality of short periods.

SUMMARY

In accordance with one embodiment, a display apparatus includes a display panel including a plurality of pixels connected with a plurality of gate lines and a plurality of data lines; a gate driver configured to drive the plurality of gate lines; a data driver configured to drive the plurality of data lines; a timing controller configured to provide the data driver with a plurality of clock signals and a data signal, to control the gate driver, and to output a voltage control signal and a gray scale compensation signal when an image signal provided from an external device has a predetermined image pattern; and a voltage generator configured to generate a plurality of operating voltages in response to the voltage control signal. Here, the data driver converts the data signal into a gray scale voltage based on reference gray scale voltages corresponding to the gray scale compensation signal and drives the data lines with the gray scale voltage converted.

The voltage generator may generate a first voltage level of analog driving voltage; and wherein the voltage generator changes a voltage level of the analog driving voltage into a second voltage level different from the first voltage level when the voltage control signal is activated. The second voltage may be lower than the first voltage level.

The voltage generator may further generate a first gamma voltage and a second gamma voltage based on the analog driving voltage.

The data driver may include a resistor string configured to generate a plurality of gamma voltages between the first gamma voltage and the second gamma voltage; a lookup table configured to store a plurality of gray scale selection signals and to output one of the gray scale selection signals in response to the gray scale compensation signal; a first decoder configured to select a part of the gamma voltages in response to a gray scale selection signal from the lookup table and to output the selected part of the plurality of gamma voltages as a plurality of gamma reference voltages; and a second decoder configured to convert data signals respectively corresponding to the data lines into the gray scale voltages based on the gamma reference voltages.

The lookup table may store a first gray scale selection signal for setting the selected part of the plurality of gamma voltages to a first gamma curve characteristic and a second gray scale selection signal for setting the selected part of the plurality of gamma voltages to a second gamma curve characteristic; and wherein the lookup table outputs one of the first and second gray scale selection signals as the gray scale selection signal in response to the gray scale compensation signal.

The timing controller may output the gray scale compensation signal such that the second gray scale selection signal is selected by the lookup table when the voltage control signal is activated.

The selected part of the plurality of gamma voltages may have the first gamma curve characteristic when the analog driving voltage has the first voltage level and the second gamma curve characteristic when the analog driving voltage has the second voltage level.

The first decoder may include a plurality of selectors each receiving the plurality of gamma voltages and outputting one of the plurality of gamma voltages as the gamma reference voltage in response to a gray scale selection signal output from the lookup table.

The second decoder may include a plurality of decoders respectively corresponding to the plurality of data lines and converting the data signals into the gray scale voltages.

The resistor string may include a plurality of resistors connected in series between the first gamma voltage and the second gamma voltage, voltages of connection nodes of the resistors being output as the plurality of gamma voltages.

In accordance with another embodiment, a display apparatus includes a display panel including a plurality of pixels connected with a plurality of gate lines and a plurality of data lines and divided into a plurality of display areas; a gate driver configured to drive the plurality of gate lines; a data driver including a plurality of data driver integrated circuits respectively corresponding to the plurality of display areas of the display panel and configured to drive corresponding data lines of corresponding display areas; a timing controller configured to provide the data driver with a plurality of clock signals and a data signal, to control the gate driver, and to output a voltage control signal and gray scale compensation signals respectively corresponding to the data driver integrated circuits when an image signal provided from an external device has a predetermined image pattern; and a voltage generator configured to generate a plurality of operating voltages in response to the voltage control signal. Here, each of the data driver integrated circuits converts the data signal into a gray scale voltage based on reference gray scale voltages corresponding to an input gray scale compensation signal and drives corresponding data lines of a corresponding display area with the gray scale voltage converted.

The voltage generator may generate a first voltage level of analog driving voltage when the voltage control signal is at an inactive state and a second voltage level of analog driving voltage when the voltage control signal is at an active state, the first voltage level being higher than the second voltage level. The voltage generator may generate first and second gamma voltages based on the analog driving voltage.

In accordance with another embodiment, a controller includes a detector to detect a pattern in an image signal; a timing controller to generate a control signal based on detection of the pattern; and a voltage generator to change at least one driving voltage for a display panel from a first level to a second level based on the control signal, wherein the pattern corresponds to at least one region having a predetermined arrangement of at least first and second gray scale values of pixels in an image corresponding to the image signal.

The voltage generator may output one or more first gamma values when the at least one driving voltage is changed from the first level to the second level, and output one or more second gamma values when the at least one driving voltage is set to the first level. The predetermined arrangement may include a checkerboard arrangement of the first and second gray scale values. The predetermined arrangement may include alternating first and second blocks, the first block may include one or more rows or columns of pixels all having the first gray scale value, and the second block may include one or more rows or columns of pixels all having the second gray scale value.

The timing controller may generate a compensation signal to at least partially offset a reduction in brightness when the at least one driving voltage is changed from the first level to the second level. The at least one region may correspond to less than all pixels of the image, and the voltage generator may change a first driving voltage for a first region of the display panel that includes the pattern, the first driving voltage changed from the first level to the second level, and set a second driving voltage at the first level for a second region of the display panel outside the first region, wherein the second region does not include the pattern.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
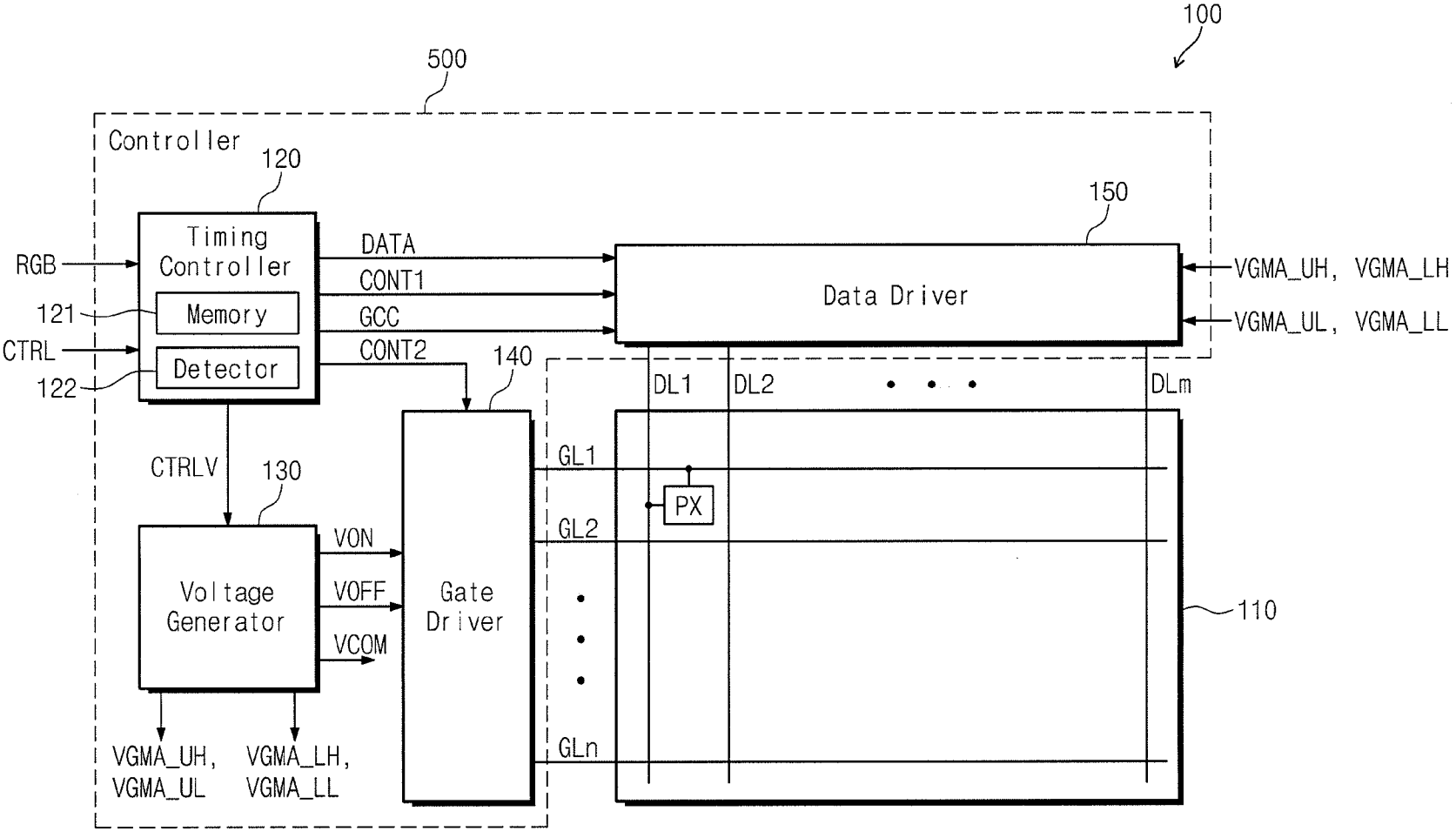
FIG. 1 illustrates an embodiment of a display apparatus.

Example embodiments will be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 illustrates an embodiment of a display apparatus 100 which includes a display panel 110, a timing controller 120, a voltage generator 130, a gate driver 140, and a data driver 150. All or a portion of the timing controller 120, voltage generator 130, gate driver 140, and data driver 150 may be considered to correspond to a controller of the display panel. For illustrative purposes, all of the aforementioned elements are shown to be included in a controller 500 in FIG. 1.

The display panel 110 includes a plurality of data lines DL1 to DLm, a plurality of gate lines GL1 to GLn intersecting with the data lines DL1 to DLm, and a plurality of pixels PX arranged at intersections of the data lines DL1 to DLm and the gate lines GL1 to GLn. The data lines DL1 to DLm may be isolated from the gate lines GL1 to GLn. Each pixel PX may include a switching transistor connected with corresponding data line and gate line and a crystal capacitor and a storage capacitor connected with the switching transistor. In other embodiments, the each pixel may have a different configuration.

The timing controller 120 may receive an image signal RGB and control signals CTRL (e.g., a horizontal synchronization signal, a vertical synchronization signal, a main clock signal, a data enable signal, etc.) from an external device. The timing controller 120 may process the image signal RGB to be suitable for an operating condition of the display panel 110 based on a control signal CTRL, and may provide a data signal DATA thus processed and a first control signal CONT1 to the data driver 150 and a second signal CONT2 to the gate driver 140. The first control signal CONT1 may include a clock signal, a polarity inversion signal POL, and a line latch signal LOAD. The second control signal CONT2 may include a vertical synchronization signal, an output enable signal, a gate pulse signal, and/or other signals. The timing controller 120 may activate a voltage control signal CTRLV and a gray scale compensation signal GCC when the image signal RGB has a predetermined image pattern.

The voltage generator 130 may generate a gate-on voltage VON, a gate-off voltage VOFF, and a common voltage VCOM for operation of the display panel 110. The voltage generator 130 may further generate a first gamma voltage VGMA_UH, a second gamma voltage VGMA_UL, a third gamma voltage VGMA_LH, and a fourth gamma voltage VGMA_LL for operation of the data driver 150.

The voltage generator 130 may set a voltage level of an analog driving voltage AVDD used in the voltage generator 130 in response to the voltage control signal CTRLV from the timing controller 120. For example, when the voltage control signal CTRLV is at an inactive state (e.g., at a low level), the voltage generator 130 may generate the analog driving voltage AVDD having a first voltage level.

When the voltage control signal CTRLV is at an active state (e.g., at a high level), the voltage generator 130 may generate the analog driving voltage AVDD having a second voltage level lower than the first voltage level. As the analog driving voltage AVDD is lowered to the second voltage level, the first gamma voltage VGMA_UH, the second gamma voltage VGMA_UL, the third gamma voltage VGMA_LH, and the fourth gamma voltage VGMA_LL generated from the voltage generator 130 may be lowered.

The gate driver 140 may drive the gate lines GL1 to GLn in response to the second control signal CONT2 from the timing controller 120 and the gate-on voltage VON and the gate-off voltage VOFF from the voltage generator 130. The gate driver 140 may include a gate driver integrated circuit. The gate driver 140 may be implemented not only by the gate driver IC, but also, for example, by a circuit using ASG (Amorphous silicon gate) using an amorphous silicon thin film transistor (a-Si TFT), oxide semiconductor, crystalline semiconductor, poly crystalline semiconductor, and so on.

The data driver 150 may output gray scale voltages for driving the data lines DL1 to DLm in response to the digital data signal DATA and the first control signal CONT1 from the timing controller 120. The gray scale voltages may be generated using the first gamma voltage VGMA_UH, the second gamma voltage VGMA_UL, the third gamma voltage VGMA_LH, and the fourth gamma voltage VGMA_LL.

Switching transistors in a row of pixels PX connected to a gate line supplied with the gate-on voltage VON through the gate driver 140 may be turned on. At this time, the data driver 150 may provide the data lines DL1 to DLm with gray scale voltages corresponding to the data signal DATA. The gray scale voltages supplied to the data lines DL1 to DLm may be applied to crystal capacitors and storage capacitors through switching transistors turned on. To prevent deterioration of the crystal capacitors, the data driver 150 may alternately drive the data lines DL1 to DLm with positive gray scale voltages and with negative gray scale voltages every frame, or on a frame-by-frame basis. The first gamma voltage VGMA_UH and the second gamma voltage VGMA_UL may be voltages used for positive driving, and the third gamma voltage VGMA_LH and the fourth gamma voltage VGMA_LL may be voltages used for negative driving.

Figure 2:
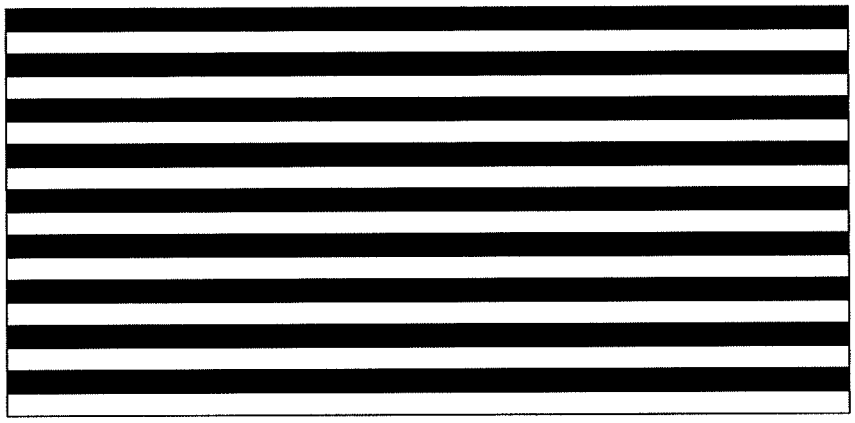
FIGS. 2 and 3 illustrate image signals provided to a display apparatus from an external device.
Figure 3:
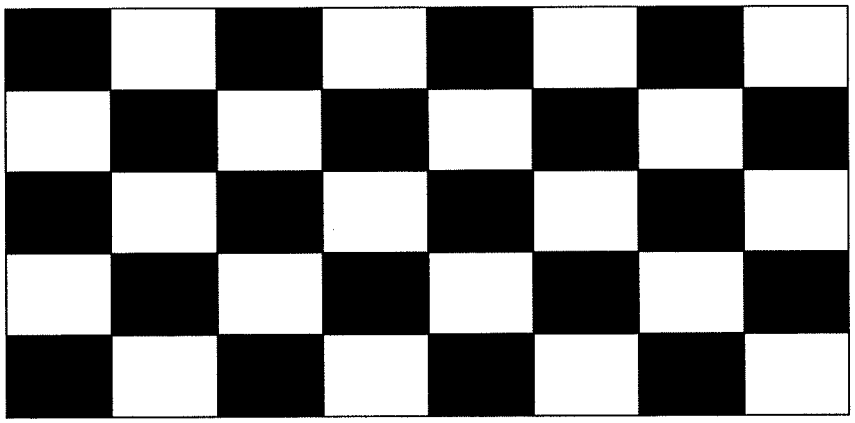

FIGS. 2 and 3 illustrate examples of image signals provided to a display apparatus from an external device. Referring to FIGS. 1 and 2, when an image signal RGB corresponds to a white gray scale at a positive mode, data lines DL1 to DLm may be driven with the maximal gray scale voltage. When an image signal RGB corresponds to a black gray scale at the positive mode, the data lines DL1 to DLm may be driven with the minimal gray scale voltage.

When an image signal RGB provided to timing controller 120 has a predetermined pattern in which a white gray scale and a black gray scale alternate on a row-by-row basis as shown in FIG. 2, gray scale voltages output from data driver 150 may have the maximal gray scale voltage level and the minimal gray scale voltage level alternately every row or every unit (block) of rows. At this time, a swing width of gray scale voltages output from the data driver 150 may be maximal. As a result, power consumption of the data driver 150 may be increased or may exist at a maximal level. Also, the temperature of the data driver 150 may increase. The same phenomenon may exist on a column-by-column basis.

When an image signal RGB provided to timing controller 120 has a predetermined image pattern as shown in FIG. 3 (e.g., checkerboard pattern), a swing width of gray scale voltages output from the data driver 150 may also be at increased or a maximal level. Thus, power consumption of the data driver 150 may be increased or at a maximal level, and consequently a temperature of the data driver 150 may increase.

When an image signal RGB is received having a predetermined image pattern as illustrated, for example, in FIGS. 2 and 3 or any other image pattern that causes an increase in power consumption of the data driver 150 or another type of change in the display panel circuits, the timing controller 120 may activate a voltage control signal CTRLV to a high level. Information on image patterns causing an increase in power consumption of the data driver 150 may be stored, for example, in a memory 121 in or coupled to the timing controller 120. The timing controller 120 may output the voltage control signal CTRLV using a detector 122. The detector 122, for example, may compare image pattern information stored at the memory with an image signal RGB input from the external device.

The predetermined image patterns shown in FIGS. 2 and 3 are examples of image patterns that may be detected in some embodiments. In other embodiments, different predetermined image patterns may be detected. For example, a different predetermined image pattern that may be detected includes a predetermined arrangement of alternating first and second blocks, where the first block includes one or more rows or columns of pixels all having the first gray scale value, and the second block includes one or more rows or columns of pixels all having the second gray scale value. The first and second gray scale values may be white and black gray scale values, or other combinations of two or more gray scale values selected from an entire range of gray scale values capable of being displayed on the display panel.

Figure 4:
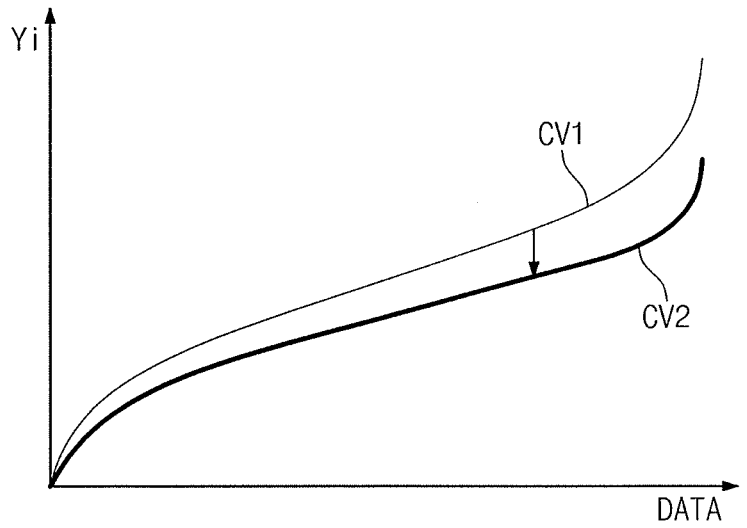
FIG. 4 illustrates an example of a variation in a positive gray scale voltage output from a data driver in FIG. 1, according to a variation in a voltage level of an analog driving voltage.
Figure 5:
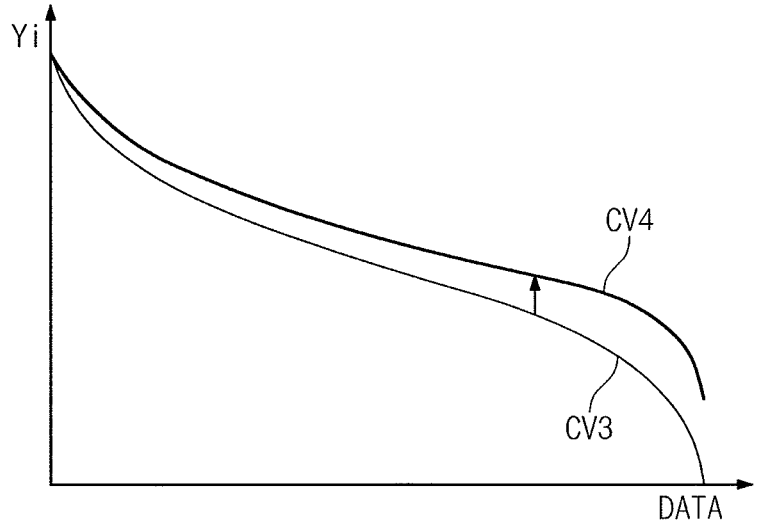
FIG. 5 illustrates an example of a variation in a negative gray scale voltage output from a data driver in FIG. 1, according to a variation in a voltage level of an analog driving voltage.

FIG. 4 illustrates an example of a variation in a positive gray scale voltage output from a data driver in FIG. 1, according to a variation in a voltage level of an analog driving voltage. FIG. 5 illustrates an example of a variation in a negative gray scale voltage output from a data driver in FIG. 1, according to a variation in a voltage level of an analog driving voltage.

When a voltage level of an analog driving voltage AVDD is lowered from a first voltage level to a second voltage level, first and second gamma voltages VGMA_UH and VGMA_UL generated from a voltage generator 130 in FIG. 1 may be lowered. Therefore, as illustrated in FIG. 4, a gamma curve indicating a positive gray scale voltage Yi provided to data lines DL1 to DLm according to a data signal DATA may be changed from a first gamma curve CV1 to a second gamma curve CV2.

Also, when the voltage level of the analog driving voltage AVDD is lowered from the first voltage level to the second voltage level, as illustrated in FIG. 5, a gamma curve indicating a negative gray scale voltage Yi provided to the data lines DL1 to DLm according to a data signal DATA may be changed from a third gamma curve CV3 to a fourth gamma curve CV4.

When either of the predetermined image patterns in FIGS. 2 and 3 are to be displayed on a display panel 110, power consumption of the data driver 150 may be reduced by lowering a voltage level of the analog driving voltage AVDD from the first voltage level to the second voltage level. However, there may be countervailing concerns. For example, the brightness of an image displayed on the display panel 110 may be lowered due to a variation in a gamma curve.

When an image signal RGB having a predetermined image pattern is received, timing controller 120 may activate a voltage control signal CTRLV and a gray scale compensation signal GCC. The data driver 150 may change a gamma curve in response to the gray scale compensation signal GCC, and may change a data signal DATA to a gray scale voltage based on the changed gamma curve. Therefore, although a voltage level of the analog driving voltage AVDD is lowered, it is possible to prevent the brightness of an image displayed on the display panel 110 from be lowered, or the amount of lowering of the brightness may be reduced.

Figure 6:
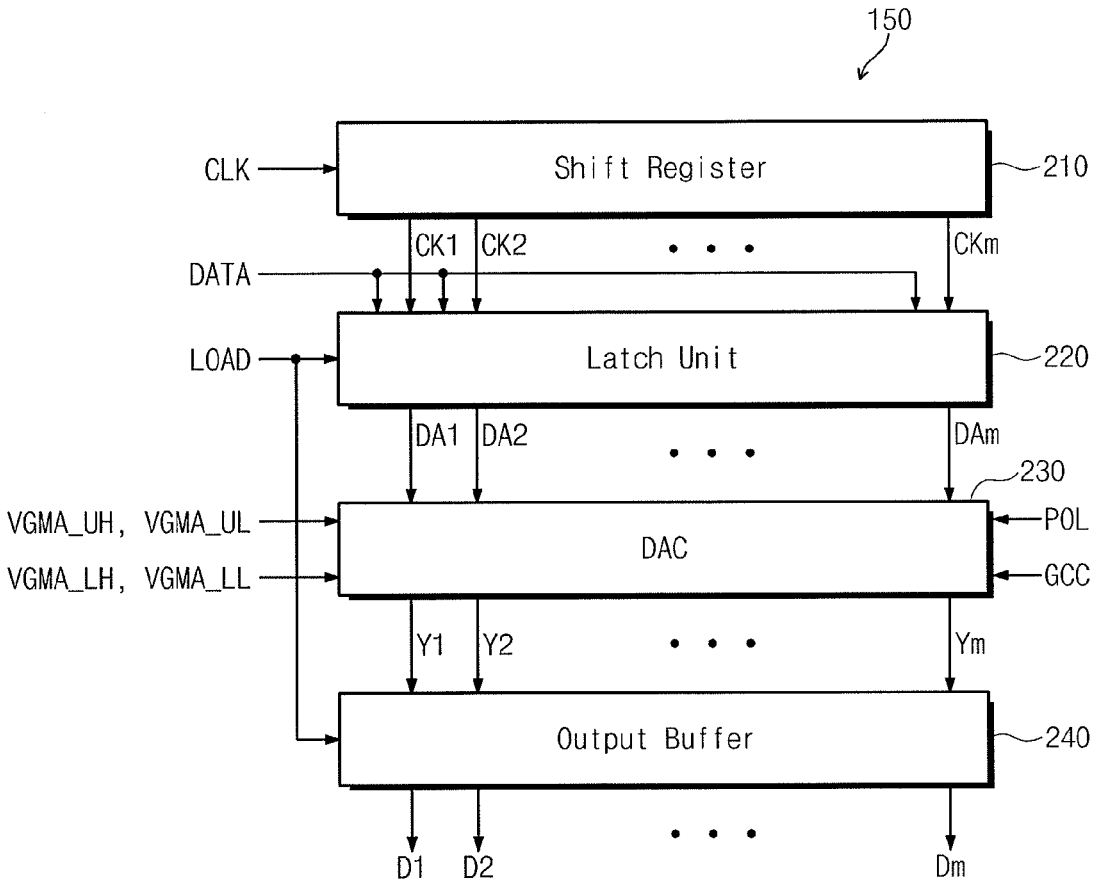
FIG. 6 illustrates an example of a data driver in FIG. 1.

FIG. 6 illustrates an embodiment of data driver 150 in FIG. 1 Referring to FIG. 6, data driver 150 includes a shift register 210, a latch unit 220, a digital-to-analog converter 230, and an output buffer 240. In FIG. 6, a clock signal CLK, a line latch signal LOAD, and a polarity inversion signal POL may be signals included in a first control signal CONT1 provided from a timing controller 120 in FIG. 1.

The shift register 210 may sequentially activate clock signals CK1 to CKm in synchronization with the clock signal CLK. The latch unit 220 may latch data in response to the clock signals CK1 to CKm from the shift register 210, and may provide the digital-to-analog converter 230 with latch data signals DA1 to Dm in response to the line latch signal LOAD.

The digital-to-analog converter 230 may receive the polarity inversion signal POL and a gray scale compensation signal GCC from the timing controller 120 and gamma voltages VGMA_UH, VGMA_UL, VGMA_LH and VGMA_LL from a voltage generator 130 in FIG. 3. The digital-to-analog converter 230 may provide the output buffer 240 with gray scale voltages Y1 to Ym respectively corresponding to the latch data signals DA1 to Dm from the latch unit 220. The output buffer 240 may output the gray scale voltages Y1 to Ym from the digital-to-analog converter 230 to the data lines DL1 to DLm in response to the line latch signal LOAD.

Figure 7:
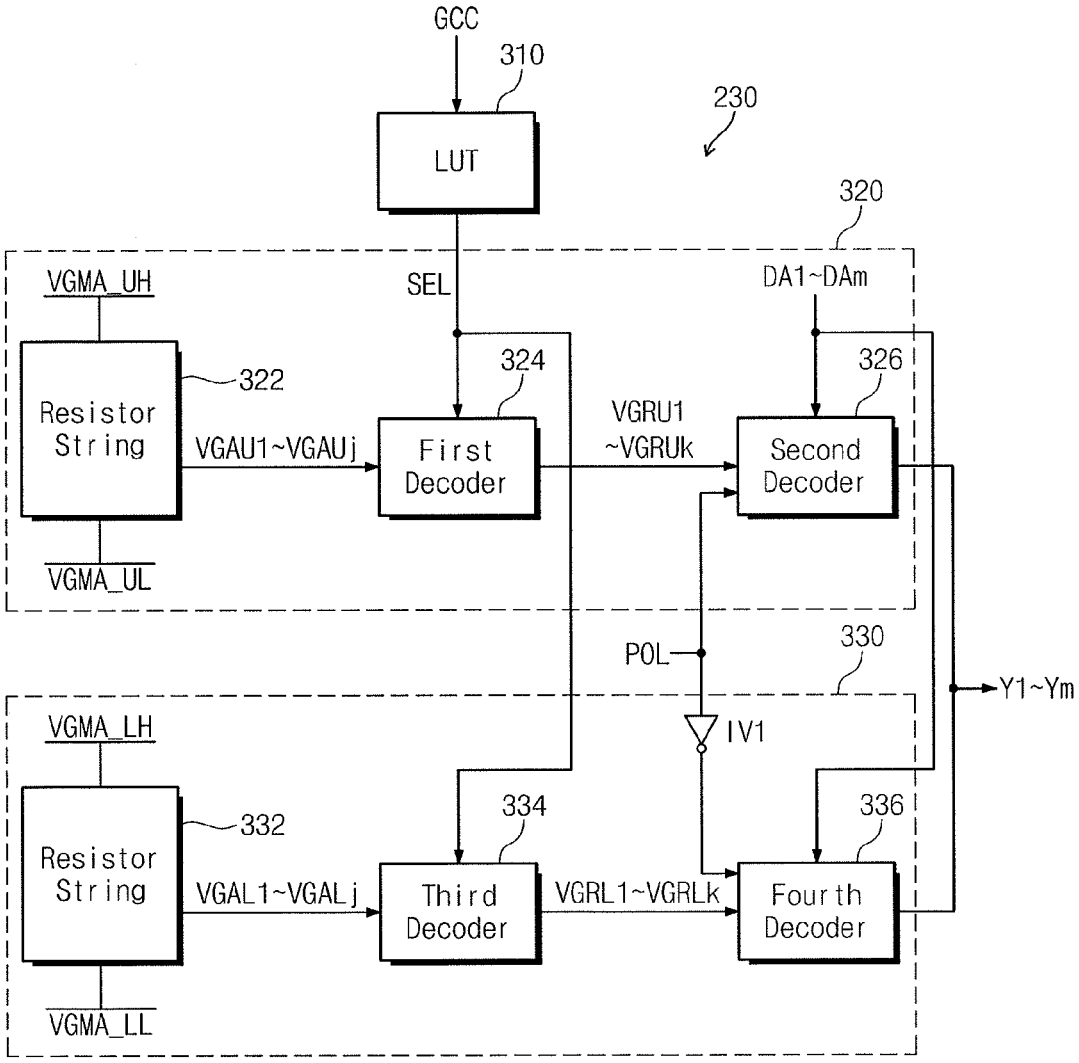
FIG. 7 illustrates an example of a digital-to-analog converter in FIG. 6.

FIG. 7 illustrates an embodiment of the digital-to-analog converter 230 in FIG. 6. Referring to FIG. 7, the digital-to-analog converter 230 includes a lookup table 310, a positive converter 320, and a negative converter 330. The lookup table 310 may store a plurality of gray scale selection signals, and may output one of the plurality of gray scale selection signals as a selection signal in response to a gray scale compensation signal GCC from a timing controller 120 in FIG. 1.

The positive converter 320 may include a resistor string 322, a first decoder 324, and a second decoder 326. The resistor string 322 may be supplied with a first gamma voltage VGMA_UH and a second gamma voltage VGMA_UL from a voltage generator 130 in FIG. 1 to generate a plurality of gamma voltages VGAU1 to VGAUj (j being a positive integer).

The first decoder 324 may output a part of the gamma voltages VGAU1 to VGAUj as gamma reference voltages VGRU0 to VGRUk (k being a positive integer) in response to a selection signal SEL from the lookup table 310. During a first level of the polarity inversion signal POL, the second decoder 326 may convert latch data signals DA1 to Dam into gray scale voltages Y1 to Ym referring to the gamma reference voltages VGRU0 to VGRUk.

The negative converter 330 may include a resistor string 332, a third decoder 334, a fourth decoder 336, and an inverter IV1. The resistor string 332 may be supplied with a third gamma voltage VGMA_LH and a fourth gamma voltage VGMA_LL from the voltage generator 130 to generate a plurality of gamma voltages VGAL1 to VGALj.

The third decoder 334 may output a part of the gamma voltages VGAL1 to VGALj as gamma reference voltages VGRL0 to VGRLk in response to the selection signal SEL from the lookup table 310. During a second level of the polarity inversion signal POL, the fourth decoder 336 may convert the latch data signals DA1 to Dam into the gray scale voltages Y1 to Ym referring to the gamma reference voltages VGRL0 to VGRLk.

Figure 8:
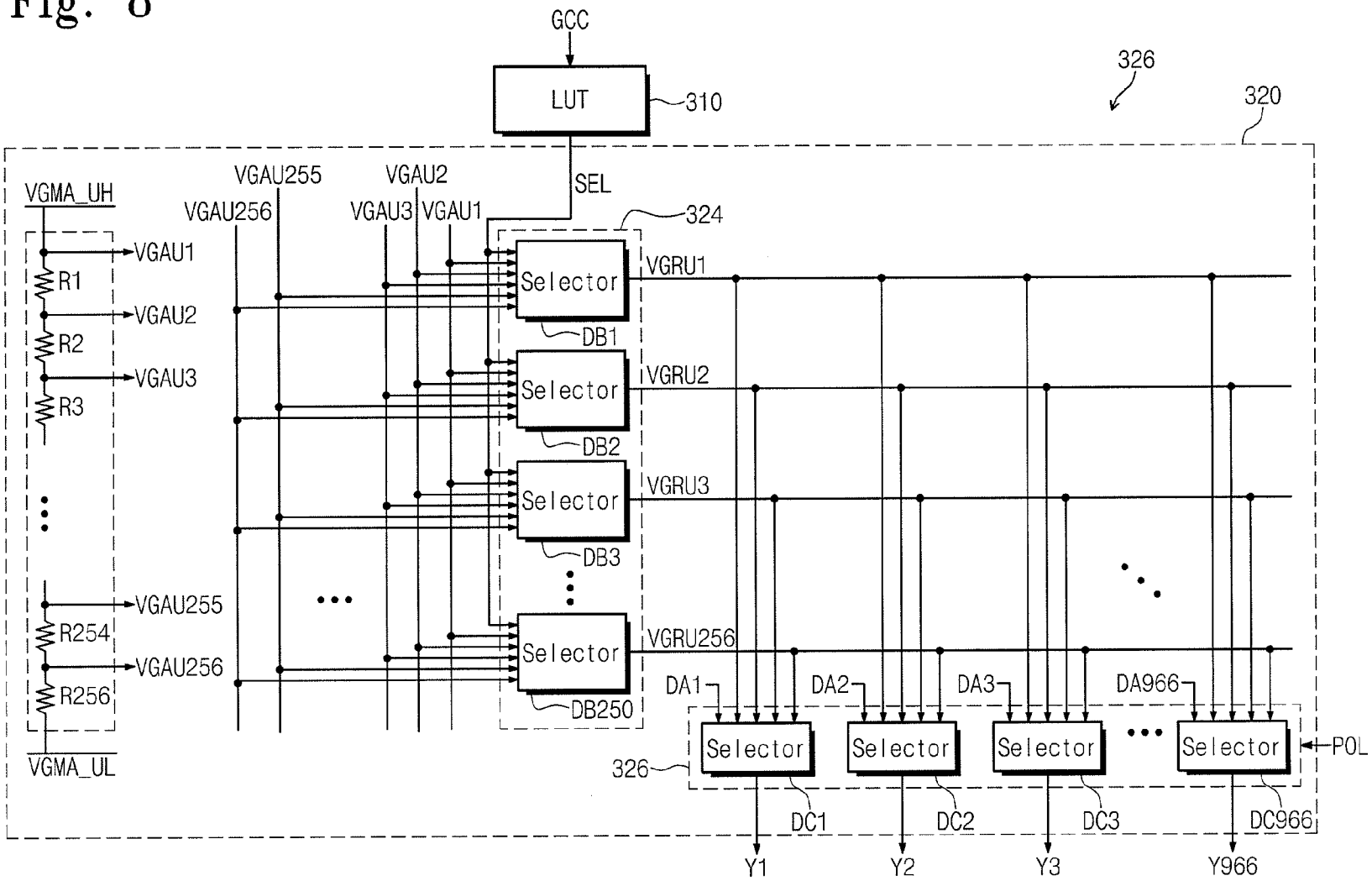
FIG. 8 illustrates an embodiment of a positive converter of a digital-to-analog converter in FIG. 7.

FIG. 8 illustrates an embodiment of a positive converter of a digital-to-analog converter in FIG. 7. In FIGS. 6 to 8, there is described an example where a data driver 150 has 966 output channels and each of latch data signals DA1 to DAm is formed of eight bits. Also, there is described an example where the number of gamma voltages VGAU0 to VGAUj output from a resistor string 322 is 256. In other embodiments, the data driver may have a different number of output channels and the latch data signals may have a different number of bits.

Referring to FIG. 8, a resistor string 322 may include 256 resistors R1 to R256 connected in series between a first gamma voltage VGMA_UH and a second gamma voltage VGMA_UL from a voltage generator 130. Voltages of connection nodes between the first gamma voltage VGMA_UH and the second gamma voltage VGMA_UL may be output as gamma voltages VGAU1 to VGAU256. Resistance values of the resistors R1 to R256 may be determined, for example, such that voltage differences of adjacent gamma voltages of the gamma voltages VGAU1 to VGAU256 are equal to one another. When each of latch data signals DA1 to DA966 is an 8-bit signal, the resistor string 322 may necessitate 256 resistors R1 to R256. In some cases, the resistor string 322 may include at least 1028 or more resistors.

A first decoder 324 may include 256 selectors DB1 to DB256, each of which is supplied with the gamma voltages VGAU1 to VGAU256. Each of the selectors DB1 to DB256 may select one of the gamma voltages VGAU1 to VGAU256 in response to a selection signal SEL from a lookup table 310. The selectors DB1 to DB256 may output selected gamma voltages as gamma reference voltages VGRU1 to VGRU256. For example, the selector DB1 may receive the gamma voltages VGAU1 to VGAU256 and select one of the gamma voltages VGAU1 to VGAU256 as a gamma reference voltage VGRU1 in response to the selection signal SEL.

Likewise, the selector DB256 may receive the gamma voltages VGAU1 to VGAU256 and select one of the gamma voltages VGAU1 to VGAU256 as a gamma reference voltage VGRU256 in response to the selection signal SEL. The selection signal SEL stored at the lookup table 310 may include gamma voltage information to be selected by each of the selectors DB1 to DB256.

A second decoder 326 may include 966 decoders DC1 to DC966 respectively corresponding to output channels of a digital-to-analog converter 230. The decoders DC1 to DC966 may convert the latch data signals DA1 to DA966 into gray scale voltages Y1 to Y966 based on the gamma reference voltages VGRU1 to VGRU256 from the selectors DB0 to DB255, respectively. For example, the decoder DC1 may output one, corresponding to the data latch signal DA1, from among the gamma reference voltages VGRU1 to VGRU256 as the gray scale voltage Y1. The decoder DC2 may output one, corresponding to the data latch signal DA2, from among the gamma reference voltages VGRU1 to VGRU256 as the gray scale voltage Y2.

Likewise, the decoder DC966 may output one, corresponding to the data latch signal DA256, from among the gamma reference voltages VGRU1 to VGRU256 as the gray scale voltage Y966. The decoders DC1 to DC966 may convert the data latch signals DA1 to DA966 into the gray scale voltages Y1 to Y966 based on the 256 (28) gamma reference voltages VGRU1 to VGRU256.

A resistor string 322, a third decoder 334, and a second decoder 366 of a negative converter 330 in FIG. 7 may be configured substantially the same as a resistor string 322, a first decoder 324, and a second decoder 326 of a positive converter 320 in FIG. 8, except that the resistor string 332 in the negative converter 330 is connected between a third gamma voltage VGMA_LH and a fourth gamma voltage VGMA_LL.

Figure 9:
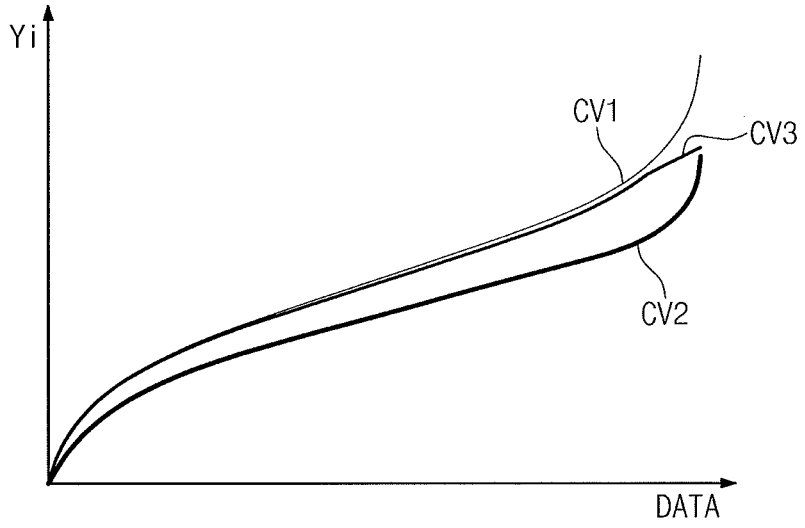
FIG. 9 illustrates an example of a variation in a positive gray scale voltage from a positive converter in FIG. 8.

FIG. 9 illustrates an example of a variation in a positive gray scale voltage from a positive converter in FIG. 8. Referring to FIG. 9, a gamma voltage indicating a positive gray scale voltage Yi, provided to data lines DL1 to DLm according to a data signal DATA when a voltage level of an analog driving voltage AVDD is lowered from a first voltage level to a second voltage level, which may be changed from a first gamma curve CV1 to a second gamma curve CV2. At this time, if a selection signal SEL output from a lookup table 310 is changed in response to a gray scale compensation signal GCC, a gray scale voltage Yi from a data driver 150 may be changed from the second gamma curve CV2 to a third gamma curve CV3. That is, while a gray scale voltage Yi corresponding to a white gray scale is lowered when a voltage level of the analog driving voltage AVDD is lowered from a first voltage level to a second voltage level, gray scale voltages corresponding to the remaining gray scales may be changed to be similar to that when the analog driving voltage AVDD has the first voltage level.

Thus, although power consumption is reduced by lowering the analog driving voltage AVDD to the second voltage level when a predetermined image pattern is received, it is possible to prevent lowering of the brightness of the remaining gray scales other than the white gray scale. In particular, in the event that image patterns illustrated in FIGS. 2 and 3 are to be displayed on a part of a display panel 110, it is possible to prevent lowering of the brightness of the remaining portions of the image having gray scale values different from a white gray scale value.

Thus, in one embodiment, voltage compensation may be selectively performed on different regions of an image when at least one of the regions corresponds to a predetermined image pattern. Also, while in previous embodiments the gray scale voltage Yi corresponding to a white gray scale is lowered when analog driving signal AVDD is lowered, in other embodiments the gray scale voltage Yi corresponding to a predetermined gray scale value other than a white gray scale value may be lowered, or otherwise adjusted. For example, the predetermined gray scale value may be any gray scale value within the total range of gray scale values that are capable of being displayed on the display panel.

Figure 10:
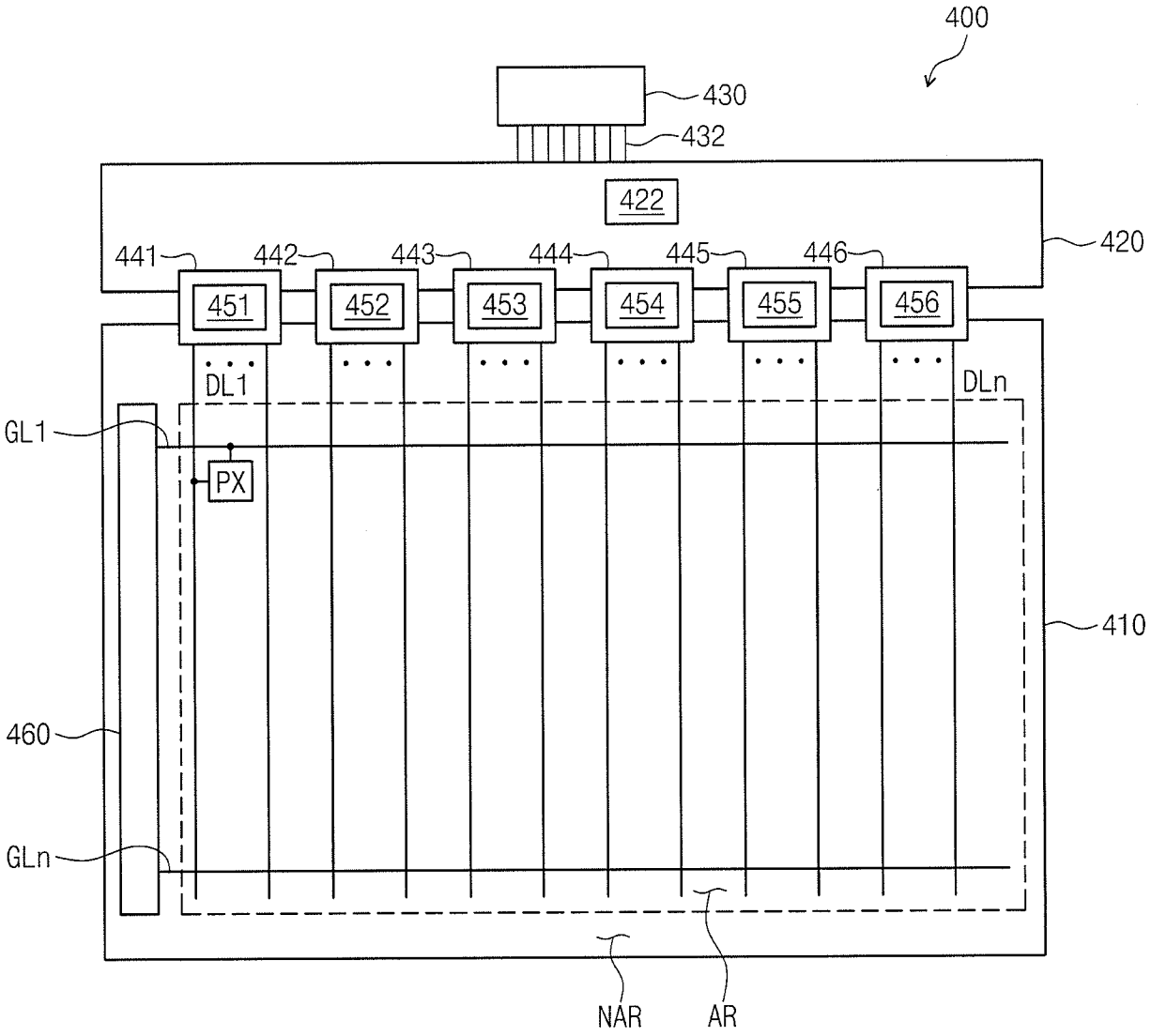
FIG. 10 illustrates another embodiment of a display apparatus.

FIG. 10 illustrates another embodiment of a display apparatus 400 which includes a display panel 410, a printed circuit board 420, a timing controller 430, a plurality of data driver circuits 441 to 446, and a gate driver 460.

The display panel 410 may include a display area AR having a plurality of pixels PX and a non-display area NAR. The display area AR may be an area for display an image, and the non-display area NAR may be an area where an image is not displayed. The display panel 410 may be implemented by a glass substrate, a silicon substrate, or a film substrate.

The printed circuit board 420 may include a voltage generator 422. The voltage generator 422 may generate a first gamma voltage VGMA_UH, a second gamma voltage VGMA_UL, a third gamma voltage VGMA_LH, and a fourth gamma voltage VGMA_LL needed to operate the data driver circuits 441 to 446. The printed circuit board 420 may further include various circuits for driving the display panel 410. The printed circuit board 420 may include a plurality of lines for connecting the timing controller 430 to the gate driver 460 and the data driver circuits 441 to 446.

The timing controller 430 may be electrically connected with the printed circuit board 420 through a cable 432. Alternatively, the timing controller 430 may be directly mounted on the printed circuit board 420.

The timing controller 430 may provide image data and a first control signal CONT1 to the data driver circuits 441 to 446 through the cable 432. The timing controller 430 may provide a second control signal CONT2 to the gate driver 460 through the cable 432. The first control signal CONT1 may include a horizontal synchronization signal, clock signals, and a line latch signal, and the second control signal CONT2 may include a vertical synchronization start signal, an output enable signal, a gate pulse signal, and so on. In example embodiments, the timing controller 430 may generate gray scale compensation signals GCC1 to GCC6 to be provided to the data driver circuits 441 to 448. The timing controller 430 may further generate a voltage control signal CTRLV to be provided to the voltage generator 422.

Each of the data driver circuits 441 to 446 may be implemented by a tape carrier package (TCP) or a chip on film (COF) such that data driver integrated circuits 451 to 456 are mounted. Each of the data driver integrated circuits 451 to 456 may drive corresponding data lines of data lines DL1 to DLm of the display panel 410 in response to the data signal, the first control signal CONT1, and the gray scale compensation signals GCC1 to GCC6 from the timing controller 430. The data driver integrated circuits 451 to 456 may be directly mounted on the display panel, not disposed on the printed circuit board 420.

In example embodiments, each of the data driver integrated circuits 451 to 456 may change a gamma characteristic curve of gray scale voltages to be provided to corresponding data lines in response to the gray scale compensation signals GCC1 to GCC6 from the timing controller 430. For example, the data driver integrated circuit 451 may change a gamma characteristic curve of gray scale voltages to be provided to corresponding data lines in response to the gray scale compensation signal GCC1 from the timing controller 430.

Likewise, the data driver integrated circuit 452 may change a gamma characteristic curve of gray scale voltages to be provided to corresponding data lines in response to the gray scale compensation signal GCC2 from the timing controller 430. The data driver integrated circuit 453 may change a gamma characteristic curve of gray scale voltages to be provided to corresponding data lines in response to the gray scale compensation signal GCC3 from the timing controller 430. The data driver integrated circuit 454 may change a gamma characteristic curve of gray scale voltages to be provided to corresponding data lines in response to the gray scale compensation signal GCC4 from the timing controller 430.

The data driver integrated circuit 455 may change a gamma characteristic curve of gray scale voltages to be provided to corresponding data lines in response to the gray scale compensation signal GCC5 from the timing controller 430. The data driver integrated circuit 456 may change a gamma characteristic curve of gray scale voltages to be provided to corresponding data lines in response to the gray scale compensation signal GCC6 from the timing controller 430.

A method where each data driver integrated circuit changes a gamma characteristic curve of gray scale voltages to be provided to corresponding data lines in response to a corresponding gray scale compensation signal from the timing controller 430 may be equal to that described with reference to FIGS. 6 to 9.

Figure 11:
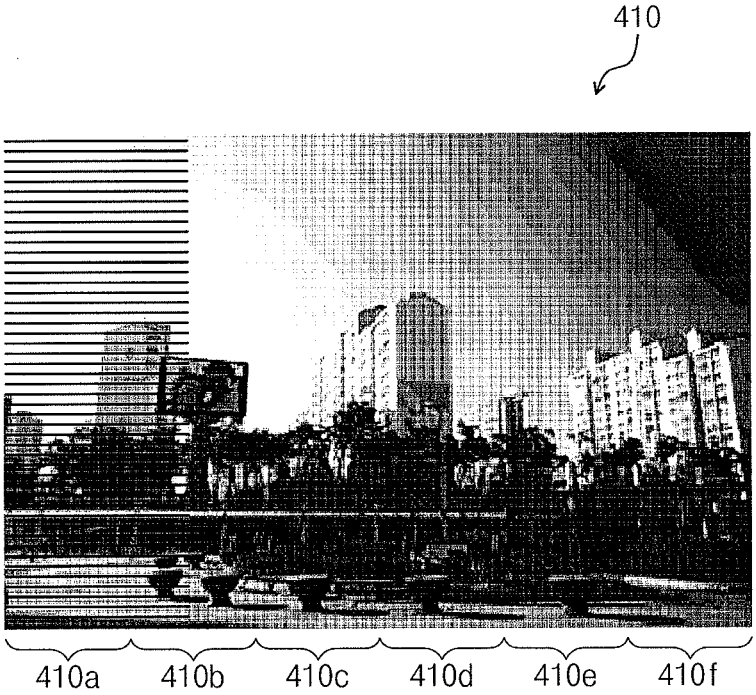
FIG. 11 illustrates an example of an image displayed on a display panel in FIG. 10.

FIG. 11 illustrates an example of an image displayed on a display panel in FIG. 10. Referring to FIGS. 10 and 11, a display area AR of a display panel 410 may include first to sixth areas 410*a* to 410*f* respectively corresponding to data driver integrated circuits 451 to 456.

When an image pattern in FIG. 2 is displayed on a part of the display panel 410, that is, the first and second areas 410*a* and 410*b*, a timing controller 410 may set gray scale compensation signals GCC1 and GCC2 corresponding to data driver integrated circuits 451 and 452, which respectively correspond to the first and second areas 410*a* and 410*b*, to a low level. The remaining gray scale compensation signals GCC3 to GCC6 may be set to a high level (or, an active level). The timing controller 410 may activate a voltage control signal CTRLV provided to a voltage generator 422 to a high level. When the voltage control signal CTRLV is activated to a high level, the voltage generator 422 may lower an analog driving voltage AVDD from a first voltage level to a second voltage level.

The data driver integrated circuits 451 and 452 may generate gray scale voltages in response to the gray scale compensation signals GCC1 and GCC2 having a low level such that a characteristic of a gray scale voltage provided to corresponding to data lines has a second gamma curve CV2 in FIG. 9. Therefore, heat generated by the data driver integrated circuits 451 and 452 respectively corresponding to the first and second areas 410*a* and 410*b* may be minimized.

Each of the data driver integrated circuits 453 to 456 may generate gray scale voltages in response to a corresponding gray scale compensation signal GCCi (i being 3 to 6) having a low level such that a characteristic of a gray scale voltage provided to corresponding to data lines has a third gamma curve CV3 in FIG. 9. Lowering of the brightness of an image displayed on the third to sixth areas 410*c* to 410*f* may be prevented.

In accordance with one or more of the aforementioned embodiments, power consumption of a data driver may be reduced by lowering a voltage level of an analog driving voltage when a specific pattern of image signal is received. Also, a gray scale voltage may be changed such that gray scale voltages to data lines are not lowered although the analog driving voltage is lowered. Thus, it is possible to prevent the quality of image from being lowered.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display apparatus, comprising:

a display panel including a plurality of pixels connected with a plurality of gate lines and a plurality of data lines;

a gate driver configured to drive the plurality of gate lines;

a data driver configured to drive the plurality of data lines;

a timing controller configured to provide the data driver with a plurality of clock signals and a data signal, to control the gate driver, and to output a voltage control signal and a gray scale compensation signal when an image signal provided from an external device has a predetermined image pattern; and a voltage generator configured to generate a plurality of operating voltages in response to the voltage control signal, wherein the data driver is to convert the data signal into a gray scale voltage based on reference gray scale voltages corresponding to the gray scale compensation signal and to drive the data lines with the gray scale voltage.

2. The display apparatus as claimed in claim 1, wherein:

the voltage generator is to generate an analog driving voltage having a first voltage level, and the voltage generator is to change a voltage level of the analog driving voltage into a second voltage level different from the first voltage level when the voltage control signal is activated.

3. The display apparatus as claimed in claim 2, wherein the second voltage is lower than the first voltage level.

4. The display apparatus as claimed in claim 2, wherein the voltage generator is to generate a first gamma voltage and a second gamma voltage based on the analog driving voltage.

5. The display apparatus as claimed in claim 4, wherein the data driver includes:

a resistor string configured to generate a plurality of gamma voltages between the first gamma voltage and the second gamma voltage;

a lookup table configured to store a plurality of gray scale selection signals and to output one of the gray scale selection signals in response to the gray scale compensation signal;

a first decoder configured to select a part of the plurality of gamma voltages in response to a gray scale selection signal from the lookup table and to output the selected part of the plurality of gamma voltages as a plurality of gamma reference voltages; and a second decoder configured to convert data signals respectively corresponding to the data lines into the gray scale voltages based on the gamma reference voltages.

6. The display apparatus as claimed in claim 5, wherein:

the lookup table is to store a first gray scale selection signal for setting the selected part of the plurality of gamma voltages to a first gamma curve characteristic and a second gray scale selection signal for setting the selected part of the plurality of gamma voltages to a second gamma curve characteristic, and the lookup table is to output one of the first gray scale selection signal or the second gray scale selection signal as the gray scale selection signal in response to the gray scale compensation signal.

7. The display apparatus as claimed in claim 6, wherein the timing controller is to output the gray scale compensation signal such that the second gray scale selection signal is selected by the lookup table when the voltage control signal is activated.

8. The display apparatus as claimed in claim 7, wherein the selected part of the plurality of gamma voltages correspond to the first gamma curve characteristic when the analog driving voltage has the first voltage level and correspond to the second gamma curve characteristic when the analog driving voltage has the second voltage level.

9. The display apparatus as claimed in claim 5, wherein the first decoder includes a plurality of selectors, each receiving the plurality of gamma voltages and outputting one of the plurality of gamma voltages as the gamma reference voltage in response to a gray scale selection signal output from the lookup table.

10. The display apparatus as claimed in claim 5, wherein the second decoder includes a plurality of decoders respectively corresponding to the plurality of data lines and converting the data signals into the gray scale voltages.

11. The display apparatus as claimed in claim 5, wherein the resistor string includes a plurality of resistors connected in series between the first gamma voltage and the second gamma voltage, voltages of connection nodes of the plurality of resistors being output as the plurality of gamma voltages.

12. A display apparatus, comprising:

a display panel including a plurality of pixels connected with a plurality of gate lines and a plurality of data lines and divided into a plurality of display areas;

a gate driver configured to drive the plurality of gate lines;

a data driver including a plurality of data driver integrated circuits respectively corresponding to the plurality of display areas of the display panel and configured to drive corresponding data lines of corresponding display areas;

a timing controller configured to provide the data driver with a plurality of clock signals and a data signal, to control the gate driver, and to output a voltage control signal and gray scale compensation signals respectively corresponding to the data driver integrated circuits when an image signal provided from an external device has a predetermined image pattern; and a voltage generator configured to generate a plurality of operating voltages in response to the voltage control signal, wherein each of the data driver integrated circuits is to convert the data signal into a gray scale voltage based on reference gray scale voltages corresponding to an input gray scale compensation signal and is to drive corresponding data lines of a corresponding display area with the gray scale voltage converted.

13. The display apparatus as claimed in claim 12, wherein the voltage generator is to generate a first voltage level of analog driving voltage when the voltage control signal is at an inactive state and a second voltage level of analog driving voltage when the voltage control signal is at an active state, the first voltage level being higher than the second voltage level.

14. The display apparatus as claimed in claim 13, wherein the voltage generator is to generate a first gamma voltage and a second gamma voltage based on the analog driving voltage.

* * * * *